United States Patent [19]

Nadherny

[11] 4,195,715

[45] Apr. 1, 1980

[54] ADJUSTABLE SUPPORT FOR BOTTOM BRAKE CONNECTING RODS FOR RAILWAY CARS

[75] Inventor: Rudolph E. Nadherny, Naperville, Ill.

[73] Assignee: Illinois Railway Equipment Company, Chicago, Ill.

[21] Appl. No.: 951,619

[22] Filed: Oct. 16, 1978

[51] Int. Cl.[2] ..... F16D 65/00

[52] U.S. Cl. ..... 188/210

[58] Field of Search ..... 188/206 R, 207, 210, 188/52; 105/217

[56] References Cited

U.S. PATENT DOCUMENTS

| | | | |
|---|---|---|---|
| 1,644,880 | 10/1927 | Hawkins | 188/210 |
| 1,841,600 | 1/1932 | Haskell | 188/210 |
| 2,232,576 | 2/1941 | Webb | 188/210 |
| 4,135,608 | 1/1979 | Adler | 188/210 |

*Primary Examiner*—George E. A. Halvosa

*Attorney, Agent, or Firm*—Lockwood, Dewey, Alex & Cummings

[57] ABSTRACT

There is provided an improved safety support for adjustable mounting on brake beams of railway cars for supporting one end of a bottom connecting rod should it become detached from the brake rigging. A flexible cable is supported by a cable retainer mounted on the side of a brake beam. The cable passes under one end of a bottom connecting rod with the ends of the cable extending generally upwardly through passageways on opposite ends of the cable retainer. Sleeve stops or other enlargements are crimped or otherwise secured to the ends of the cable so as to prevent the cable ends from being withdrawn downwardly through the passageways. The cable retainer has a plurality of holes so that it may be mounted in various positions on the brake beam thereby allowing the cable to be adjusted to several different elevations. By providing the cable with additional sleeve stops it can in effect be shortened to different effective lengths.

8 Claims, 5 Drawing Figures

30
31
32
33
34
35
36
37
38
40
41
42
43
44
45
46
47
48
50
51

ADJUSTABLE SUPPORT FOR BOTTOM BRAKE CONNECTING RODS FOR RAILWAY CARS

This invention relates, generally, to railway car construction and it has particular relation to improvements in supports for bottom connecting rods underlying the brake beams and forming a part of the brake rigging.

In the past it has been customary to employ rigid, generally "U"-shaped, safety straps for underlying bottom connecting rods forming a part of the brake rigging of railway cars. For example, $1\frac{1}{4}''$ by $\frac{1}{4}''$ steel bars have been used with the apertured upper ends secured by $\frac{1}{2}''$ diameter bolts to the inner sides of a pair of oppositely disposed brake beams. The bottom connecting rods are spaced only a slight distance above the track rails. The safety straps necessarily extend below the bottom connecting rods and close to the tops of the rails where they are susceptible to damage and likely to be bent or broken. Damaged safety straps and missing bolts are often found in cars that have been in service for some time. It has been noted that derailments have been caused by fallen bottom connecting rods which could have been prevented if the safety support had been operable.

The proposal has been made to employ 3/16" plastic coated cable for underlying the bottom connecting rods. Bolting clips are secured to the ends of the cable by swaging for receiving bolts for attachment to the brake beams. Examination of several cars in actual service using this type of support revealed some were missing, some were loose and some had the cable worn where it rubbed on the underside of the bottom connecting rod it was intended to prevent from dropping in case it should become disconnected from the brake rigging.

In application Ser. No. 832,287 filed Sept. 12, 1977, U.S. Pat. No. 4,135,608 dated Jan. 23, 1979 improved means are disclosed for supporting the opposite ends of a flexible support cable at various heights. The means disclosed in Ser. No. 832,287 require at least one separate attachment piece for each end of a support cable. In the present invention, one relatively simple cable retainer replaces the plurality of separate attachment pieces required in means disclosed in Ser. No. 832,287.

The object of the invention, generally stated, is the provision of a new and improved safety support for adjustable mounting on brake beams of railway cars for supporting one end of a bottom connecting rod should it become detached from the brake rigging, such safety support being characterized by its minimum number of parts, economy of production, versatility, ease of installation and reliability.

Certain more specific objects of the invention will appear hereinafter in connection with the following detailed description of a preferred embodiment of the invention.

Figure 1:
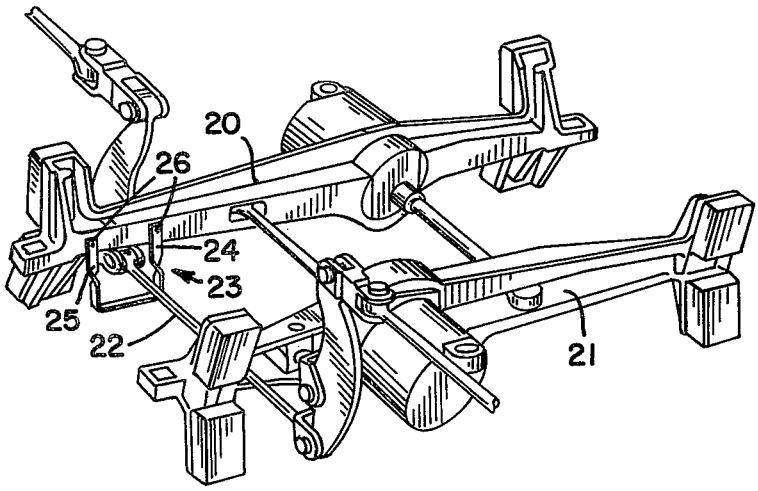
FIG. 1 PRIOR ART
FIG. 1 is a perspective view of a conventional railway car brake assembly showing a pair of spaced apart brake beams having mounted on one of them a safety support of the prior art construction underlying a bottom connecting rod, it being understood that a safety support is mounted on each brake beam near the ends of the bottom connecting rod.

Referring to FIG. 1, which shows a conventional prior art construction, reference characters 20 and 21 designate brake beams at the "B" end of a railway car having a bottom connecting rod 22 underlying them. Each brake beam is provided with a safety support, one of which is shown, generally, at 23. It is formed of a steel bar, as described above, and is generally stirrup-shaped with apertured twisted upper ends 24 and 25 for receiving bolts 26 that extend through the respective brake beam 20.

The presently preferred embodiment of this invention is illustrated in FIGS. 2–5. A portion of a brake beam is shown at 30 and the corresponding bottom connecting rod is shown at 31. At 32 there is indicated generally, a safety support for the bottom connecting rod 31 which comprises two principal parts. One part is a flexible cable 33, preferably a 3/16" 7×7 galvanized aircraft cable, having a pair of upper sleeve stops 34—34 formed of galvanized steel swaged to its upper ends and a pair of similar lower sleeve stops 35—35 likewise swaged to opposite sides of the cable.

Figures 3, 4, 5:
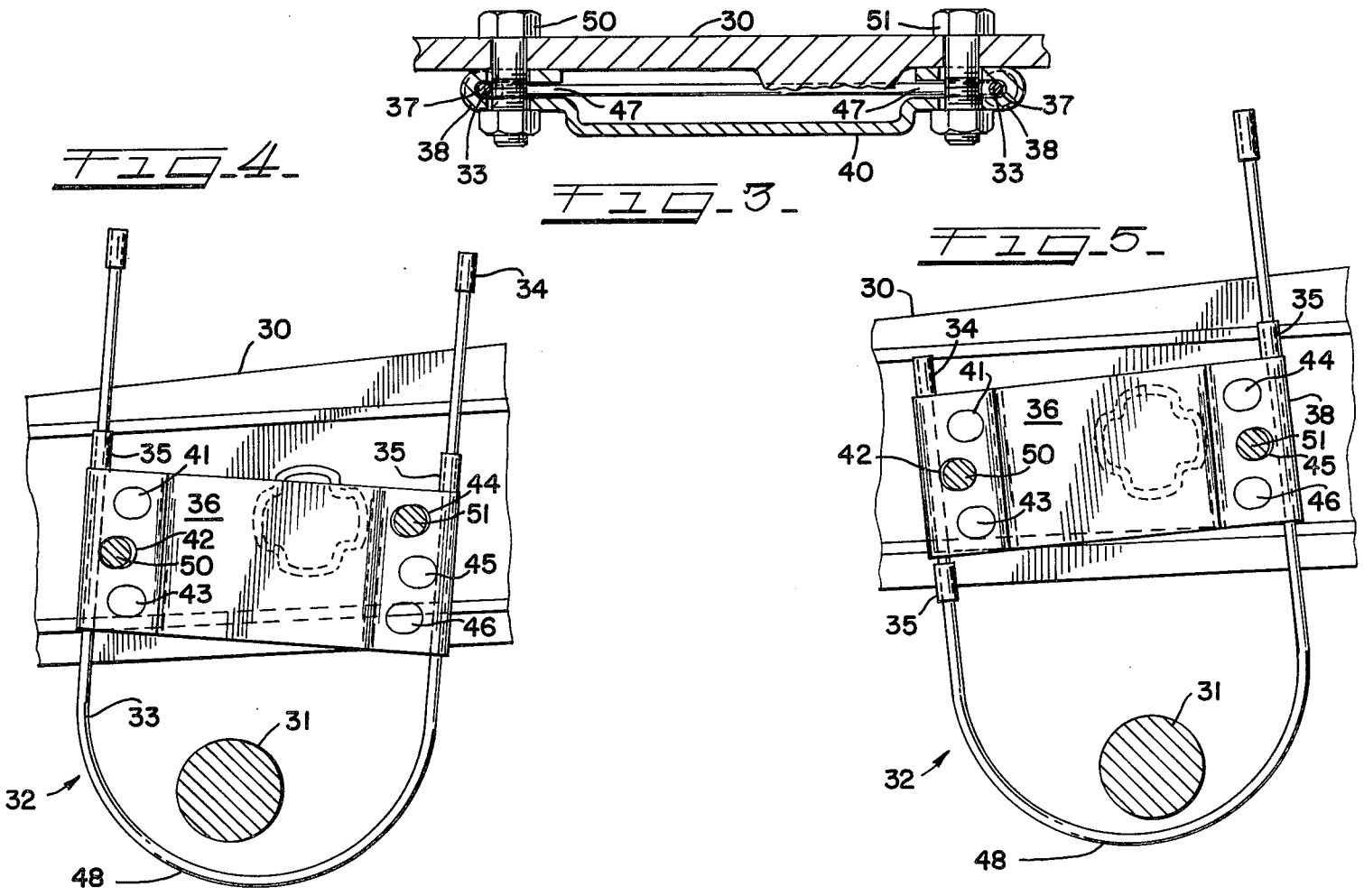
FIG. 3 is a view taken on line 3—3 of the safety support shown in FIG. 2, with the adjustable attachment piece located in one of several positions in which it may be mounted on a brake beam.
FIGS. 4 and 5 are views corresponding to FIG. 2 but showing the safety support mounted in two different positions on the brake beam.

The second part of the safety support 32 is a cable retainer which is indicated at 36. This retainer is generally rectangular in shape and may be formed by known shop procedures from sheet metal or other suitable material. The opposite ends 38—38 of the blank from which the retainer 36 is formed are doubled over or folded over on each other as indicated in FIG. 3 so as to form a vertical elongated passageway 37 at the bight of each fold. The folded-over ends 38 are separated by an intermediate, outwardly offset, portion 40. Each of the ends 38—38 is provided with three bolts holes 41, 42, 43 and 44, 45, 46, respectively. These holes are somewhat enlarged or elongated in one direction to facilitate adjustment and mounting of the retainer 36 in different positions as will be explained below.

It will be noted from FIG. 3 that the folded ends 38—38 are not completely collapsed but remain separated so as to leave a space 47 opening toward the inside of each end 38. The spaces 47 are of sufficient width so as to permit ready insertion therein of the cable 33.

Figure 2:
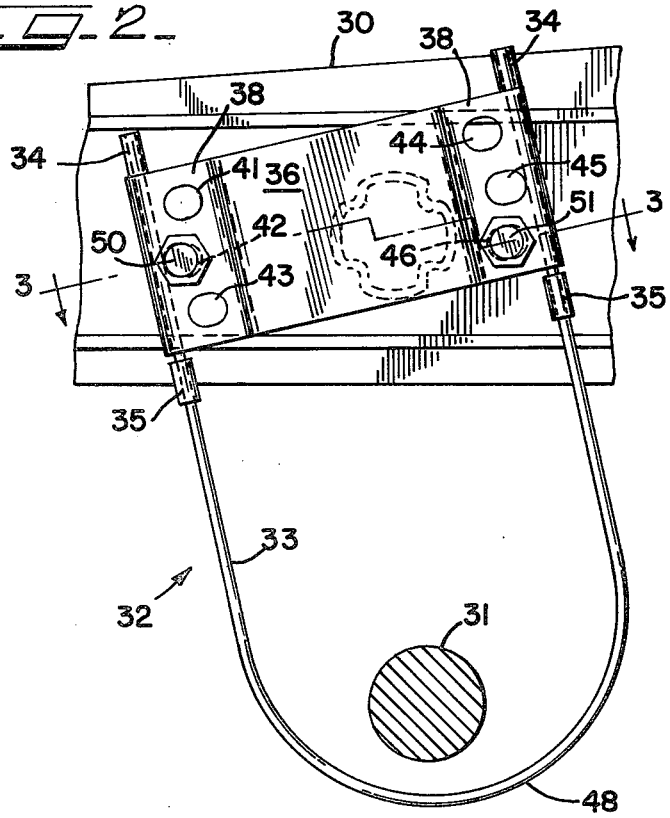
FIG. 2 is a fragmentary view, in front elevation, of a safety support for the bottom connecting rod in which this invention is embodied.

It will be seen from FIGS. 2, 4 and 5 that the sleeve stops 35—35 are crimped or swaged onto the cable a distance from the end sleeve stops 34 which somewhat exceeds the vertical dimension of the ends 38—38. Accordingly, in FIG. 2 the sleeve stops 34—34 engage the upper ends or edges of the respective ends 38—38 while the lower sleeve stops 35—35 are spaced slightly below the lower edges thereof. It will be appreciated FIG. 2 that the upper sleeve stops 34—34 prevent the cable 33 from being withdrawn downwardly through the respective passageways 37 in the event that the connecting rod 31 drops onto the bight portion 48 of the cable so as to place a load thereon.

The distance between the bottom connecting rod 31 and its associated brake beam 39 varies from railway car to railway car. Hence, there is a need for the safety support 32 to be adjustable so as to accommodate these different spacings of the connecting rods 31. In the installation shown in FIG. 2, the cable 33 is extended to its maximum length below the retainer 36 since each of the sleeve stops 34 at the opposite ends of the cable 33 engage the upper edges of the retainer 36 at the folded over ends 38.

In the particular installation shown in FIG. 2, it is desirable that the retainer 36 be mounted in a tilted condition so as to position the cable bight 48 properly under the rod 31. Hence, the retainer is mounted on the brake beam 30 by bolts 50 and 51 so that bolt 50 extends through opening or bolt hole 42 while bolt 51 extends through bolt hole 46. The bolts 50 and 51 are mounted in bolt holes provided therefor in the brake beam 30.

It will be seen from FIG. 3 that with the cables 33 extending upwardly through the passageways provided in the outer ends of the end portions 38—38, the juxtaposed bolts 50 and 51 serve to retain the cable ends in position in the passageways. Such retaining action provided by the bolts 50 is a safety feature which augments the normal tendency of the cable ends to remain in the open-sided passageways 37 due to the natural spring action of the cable 33 when formed of a material such as the above-mentioned aircraft cable.

The manner in which the safety support 32 is assembled and mounted on the brake beam 30, as shown in FIG. 2, is relatively simple and easily accomplished. Starting with the retainer 36 separated from the cable 33, one of the opposite ends of the cable 33 (e.g. the right-hand end) is inserted through the space 47 into the passageway 37 in the right-hand folded-over end portion 38 in the retainer 36 in such a way that the upper swaged sleeve stop 34 rests on the upper edge of the vertical passageway 37. Then with the bolt 51 in place in the beam 30 and with its nut removed, hole 44 is placed over the threaded end of bolt. The nut is then placed on the threaded end of bolt 51 and loosely tightened. The free end of the cable 33 is brought around under the rod 31 and then inserted into the passageway 37 in the left-hand end of the retainer 36. The bolt hole 42 is aligned with the hole in the beam 30 and then bolt 50 is inserted. The nuts are then tightened on both bolts 50 and 51. It will be appreciated that other installations may be used.

When the retainer 36 is formed of a suitable resilient material such as spring steel, the folded-over ends 38 act as lock washers when the nuts are drawn up on the bolts.

In FIGS. 4 and 5 the safety support 32 is shown mounted on the brake beam 30 in two different positions and conditions. Thus, in FIG. 4 the ends of cable 33 are inserted into the passageways 37 so that the swaged sleeve stops 35—35 are in engagement with the upper edges of the edges of the ends 38 of the retainer 36. Further, the retainer is mounted so that bolt 51 extends through the bolt opening 44 instead of through the bolt opening 46 as in FIG. 2. It will be noted in FIG. 4 that the brake rod 31 is much closer to the bottom side of the brake beam 30 than it is in FIG. 2.

In FIG. 5, the cable 33 is inserted into the retainer 36 in such manner that the upper sleeve stop 34 on the left-hand end is in engagement with the upper edge of the retainer end 38 while on the opposite side the lower sleeve stop 35 is engaged with the upper edge of the passageway 37 through the opposite end 38. In the installation shown in FIG. 5, the bolts 50 and 51 extend through the respective middle bolt holes 42 and 45. It will be seen from FIG. 5 that the rod 31 is spaced from the bottom edge of the brake beam 30 a distance intermediate between the spacings in FIGS. 2 and 4.

It will be appreciated, the retainer 36 may be mounted on the brake beam 30 using any combination of the holes 41, 42, 43, 44, 45, 46. Likewise, the cable ends may be inserted in the passageways in various ways as illustrated in FIGS. 2–5.

Since the holes 41–46 are somewhat oversize for the bolts 50 and 51 the different distances between opposing holes may be accommodated. Thus, the distance between holes 41 and 44 is somewhat less than the distance between holes 41 and 46.

What is claimed is:

1. For combination with a railway car having spaced apart brake beams and a bottom connecting rod disposed on the underside thereof forming part of a brake rigging and likely to become detached and drop to the road bed, safety means for preventing said bottom connecting rod from so dropping, comprising: a flexible cable for underlying said bottom connecting rod with the ends extending upwardly on opposite sides of said connecting rod and a one-piece cable retainer having elongated generally parallel, cable-retaining passageways extending along opposite ends thereof, each end of said cable extending generally upwardly through one of said passageways, stop means secured to each end of said cable and serving to prevent the cable end from being drawn downwardly through said passageway through which it extends, and said cable retainer having at least one pair of spaced bolt-receiving holes adjacent each opposite end thereof whereby said retainer may be mounted in a plurality of positions on one of said brake beams.

2. Safety means as called for in claim 1 wherein said cable retainer is formed of sheet material and said passageways are formed by opposite ends of said material overlying itself so as to form one of said passageways at each end.

3. Safety means as called for in claim 2 wherein said cable has sufficient stiffness so that its opposite ends tend to spring apart and press against the closed sides of said passageways when released when said cable is formed into a U-shape.

4. Means as called for in claim 2 wherein said passageways are open on their confronting sides and said bolt-receiving holes extend through overlying portions of said material and are juxtaposed to the inner sides of said passageways so that bolts therein will retain said cable ends therein.

5. Means as called for in claim 4 wherein said cable retainer is formed of a resilient material whereby said overlying portions resist being collapsed when said bolts are tightened and thereby exert a lock-washer action.

6. Safety means as called for in claim 2 wherein said cable retainer is generally rectangular when said passageways are formed on opposite sides and the body of said retainer intermediate said opposite sides is outwardly offset.

7. Safety means as called for in claim 1 wherein each end of said cable has at least one additional stop means secured thereto with the stop means being spaced apart a distance at least equal to the length of said passageway through which the cable end extends.

8. In a railway car having spaced apart brake beams and a bottom connecting rod disposed on the underside thereof forming part of a brake rigging likely to become detached and drop to the road bed, in combination with said brake beams and bottom connecting rod, safety means for preventing said bottom connecting rod from so dropping comprising: a flexible cable for underlying said bottom connecting rod with the ends extending upwardly on opposite sides of said connecting rod, and a one-piece cable retainer having elongated generally parallel, cable-retaining passageways extending along opposite ends thereof, each end of said cable extending generally upwardly through one of said passageways, stop means secured to each end of said cable and serving to prevent the cable end from being drawn downwardly through said passageway secured to each end of said cable and serving to prevent the cable end from being drawn downwardly through said passageway through which it extends, and said cable retainer having at least one pair of space bolt-receiving holes adjacent each opposite end thereof whereby said retainer may be mounted in a plurality of positions on one of said brake beams.

* * * * *